United States Patent [19]

Drazinakis

[11] Patent Number: 4,865,319

[45] Date of Patent: Sep. 12, 1989

[54] TENNIS TRAINING DEVICE

[76] Inventor: Evan G. Drazinakis, 22 Forty Oaks Rd., Whitehouse Station, N.J. 08889

[21] Appl. No.: 240,177

[22] Filed: Aug. 26, 1988

[51] Int. Cl.[4] ..... A63B 61/00

[52] U.S. Cl. ..... 273/29 A; 273/26 E; 273/413

[58] Field of Search ..... 273/26 E, 29 R, 29 A, 273/413, 414, 184 B, 185 E, 185 D

[56] References Cited

U.S. PATENT DOCUMENTS

| | | | |
|---|---|---|---|
| 1,441,221 | 1/1923 | Fourcher | 273/26 E |
| 3,885,790 | 5/1975 | Parr | 273/26 E |
| 3,893,669 | 7/1975 | Myers | 273/26 E |
| 3,994,494 | 11/1976 | Kelley | 273/26 E |
| 4,706,964 | 11/1987 | Genovese | 273/26 E |

*Primary Examiner*—Edward M. Coven

*Assistant Examiner*—T. Brown

*Attorney, Agent, or Firm*—Barry G. Magidoff

[57] ABSTRACT

A tennis training apparatus having a vertical tubular support stand support by a base. A horizontal tubular member is attached at one of its ends to the top end of the vertical support stand. A rotatable support head is attached to the other or outer end of the horizontal support. The rotatable head is attached to the horizontal support such that its axis of rotation is parallel but offset from the longitudinal axis of the horizontal support. A flexible filamentary line is threaded along the longitudinal axis of the horizontal and vertical supports and the rotatable head; one end of the filamentary line is threaded through the wall of the vertical support. The other end of the filamentary line is attached to a ball attachment structure.

6 Claims, 3 Drawing Sheets

FIG. 1
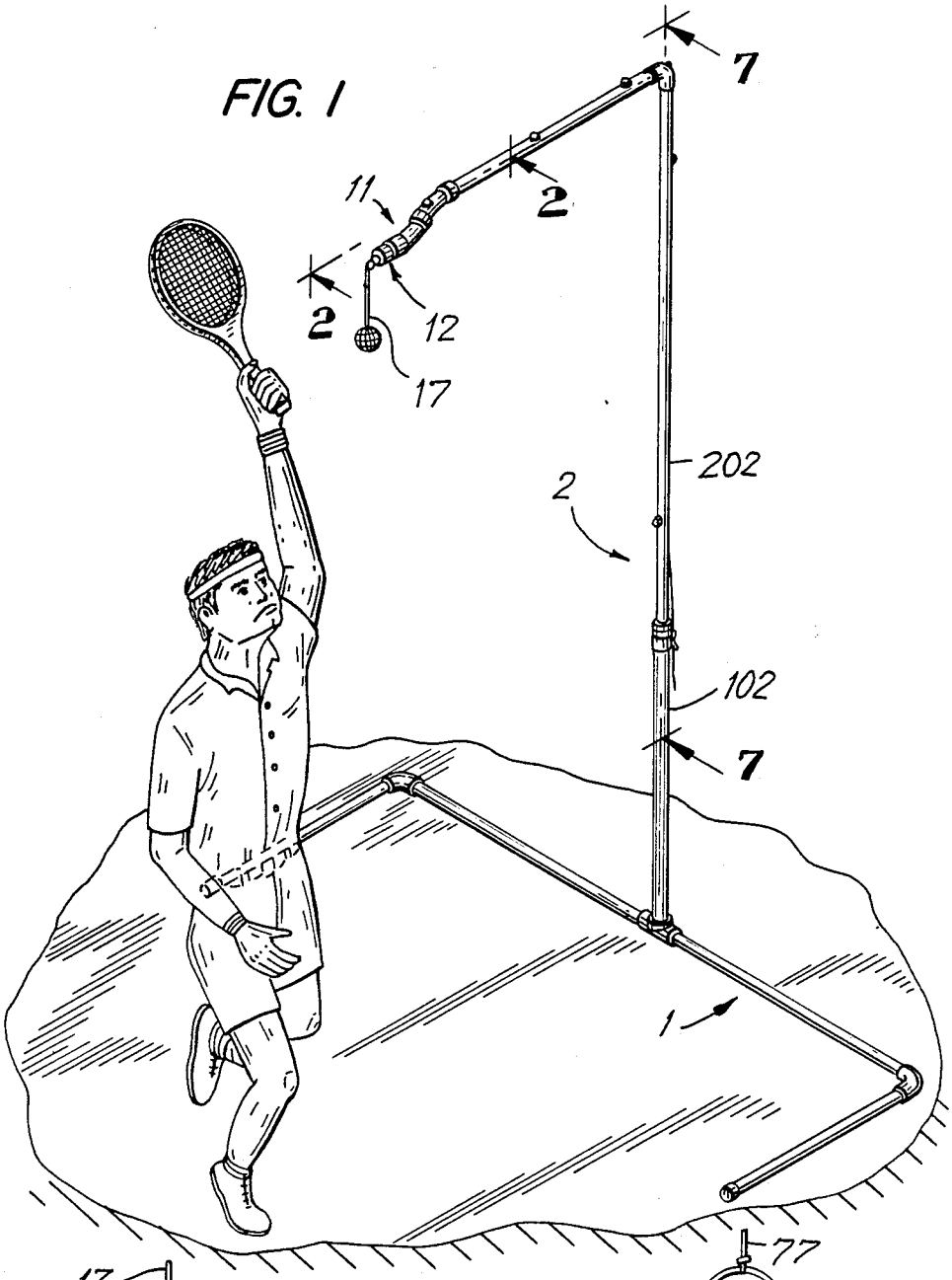
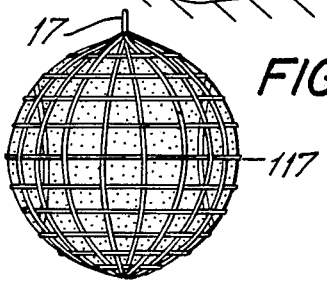
FIG. 5
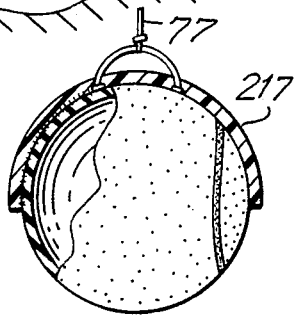
FIG. 6

TENNIS TRAINING DEVICE

The present invention generally relates to practice training apparatus, and specifically for the game of tennis, or other racket sports, which can be utilized by a single individual playing without an opponent or partner.

BACKGROUND OF THE INVENTION

The various racket sports, whether tennis, or racketball, or even squash, involves a series of moves, or strokes, referred to as service or volley. Games which specifically involve striking a ball over and across the net to be returned by the opposing player further involves such moves as ground strokes, overhead strokes, and various strokes which result in a spin on the ball, so as to provide desired effects upon striking the ground on the other side of the net.

Tennis especially requires that the player have a smooth and confident stroke which can be made by the player substantially automatically and without conscious thought, while doing so in a manner which not only results in the ball moving in the desired direction, but also permits the player to strike the ball repeatedly without excessive tiring or injury.

All such moves require continued practice and it is often difficult as well as expensive for the beginning player to practice these desirable moves on a tennis court with sufficient repetition that the player quickly improves, at least with respect to the rudimentary moves required for swinging the racket.

A variety of devices have been proposed in the past to enable the players, especially the beginning player, to practice the sport alone, often in the privacy of his home, until reaching a minimum state of proficiency and lack of awkwardness so as to avoid embarrassment when playing on a court in public. These prior devices most generally involve a longitudinal stand which supports the ball, usually from a cord, or other rope-like means, with sufficient length of a flexible tether to enable the ball to be struck by the racket or, in the case of practicing the serve, to throw the ball in the air and to strike the ball with the racket upon its falling back toward the player. Such devices are described, for example, in U.S. Pat. Nos. 4,191,372, 3,893,669, 4,269,410, 3,861,679, and in a particularly unusual one involving a fishing rod, No. 4,079,934.

These devices, although all apparently similar, differ from each other in various minor ways However, a common problem involves the problem of entanglement of the cord or other flexible filament holding the tennis ball in place. This is a common problem with all devices that retain the ball rather than permit it to be released upon being struck In addition, those which have releasable means for holding the ball, such that the ball will move when struck, have the similar problem because the means holding the ball remain with the cord and act as a similar kind of weight. In all cases, the cord tends to end up wrapped around the horizontal holding member, rendering it difficult to strike again.

SUMMARY OF THE PRESENT INVENTION

It is therefore an object of this invention to provide a means for allowing solo tennis practice which will support a tennis ball or the like at a variable height, adjustable in accordance with the needs or desires of the practitioner, which will allow the ball to be either tethered or to travel upon being struck, and will not create or result in entanglement of the line on the support means.

It is a further object of this invention to provide an apparatus for the suspension of a ball for practicing of a racket sport. It is a further object of the present invention to provide a tennis practice device which can be economically manufactured It is yet another object of the present invention to provide a racket sport practice device which is sturdy and stable, but is yet sufficiently light as to be portable even in the usable condition. It is a further object of the present invention to provide a racket for training people which can be adjustable as to height.

These and other objects for the invention are obtained by a device which comprises a vertically adjustable support post, base means for maintaining the support post in a vertical position and a horizontal member extending outwardly from an upper portion of the support post; a support head at the outer end of the horizontal member, the support head being rotatable relative to the horizontal member and a flexible linear support means supported from the support head and passing interiorly of the horizontal member and of the vertical support member to a location adjacent a lower portion of the vertical support means; and means for vertically adjusting the vertical support member. The telescopic vertical support post portions are formed of different sized tubing, such that the outside diameter of one of the tubes is sufficiently small as to fit slidably within the internal diameter of the other tube. Preferably, in the embodiment shown in the drawings, the upper, longer tube 202 has an outside diameter sufficiently small to fit within the interior opening of the lower, short post 102 Preferably, the support head is vertically offset from the major portion of the horizontal member.

BRIEF DESCRIPTION OF THE DRAWINGS

FIG. 1 is an isometric view of an assembled device in fully extended position, i e., as would be used for service practice;

FIG. 2 is an enlarged partial cross-sectional view taken along lines 2—2 of FIG. 1 of the ball support head of the device of the present invention;

FIG. 5 is an enlarged view of a secured connector for holding a ball;

FIG. 6 is an enlarged cross-sectional view of a releasable connector for holding the ball;

Figures 3, 4:
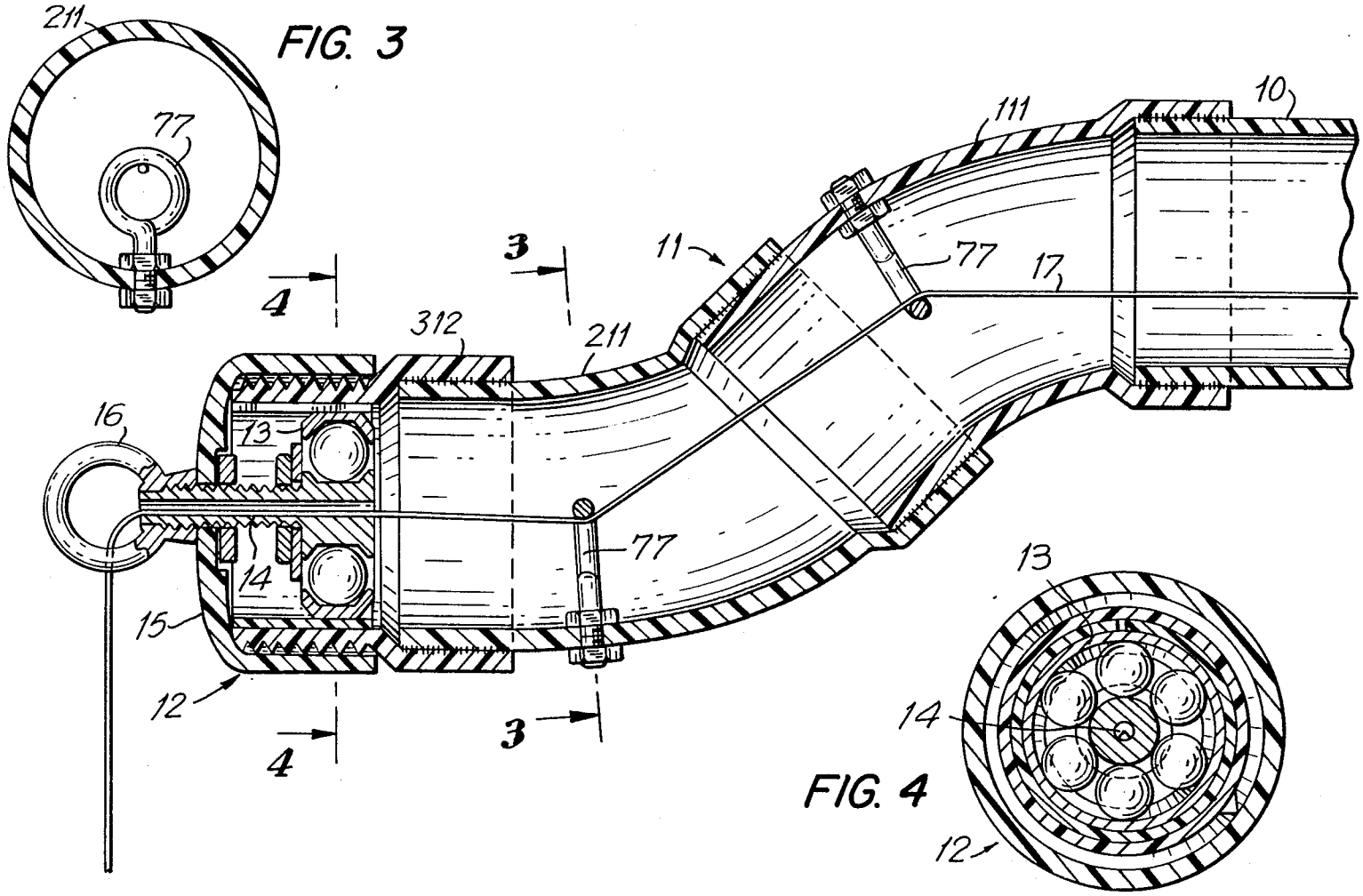
FIG. 3 is a cross-sectional view taken along lines 3—3 of FIG. 2.
FIG. 4 is a cross-sectional view taken along lines 4—4 of FIG. 2.
Figures 7, 8:
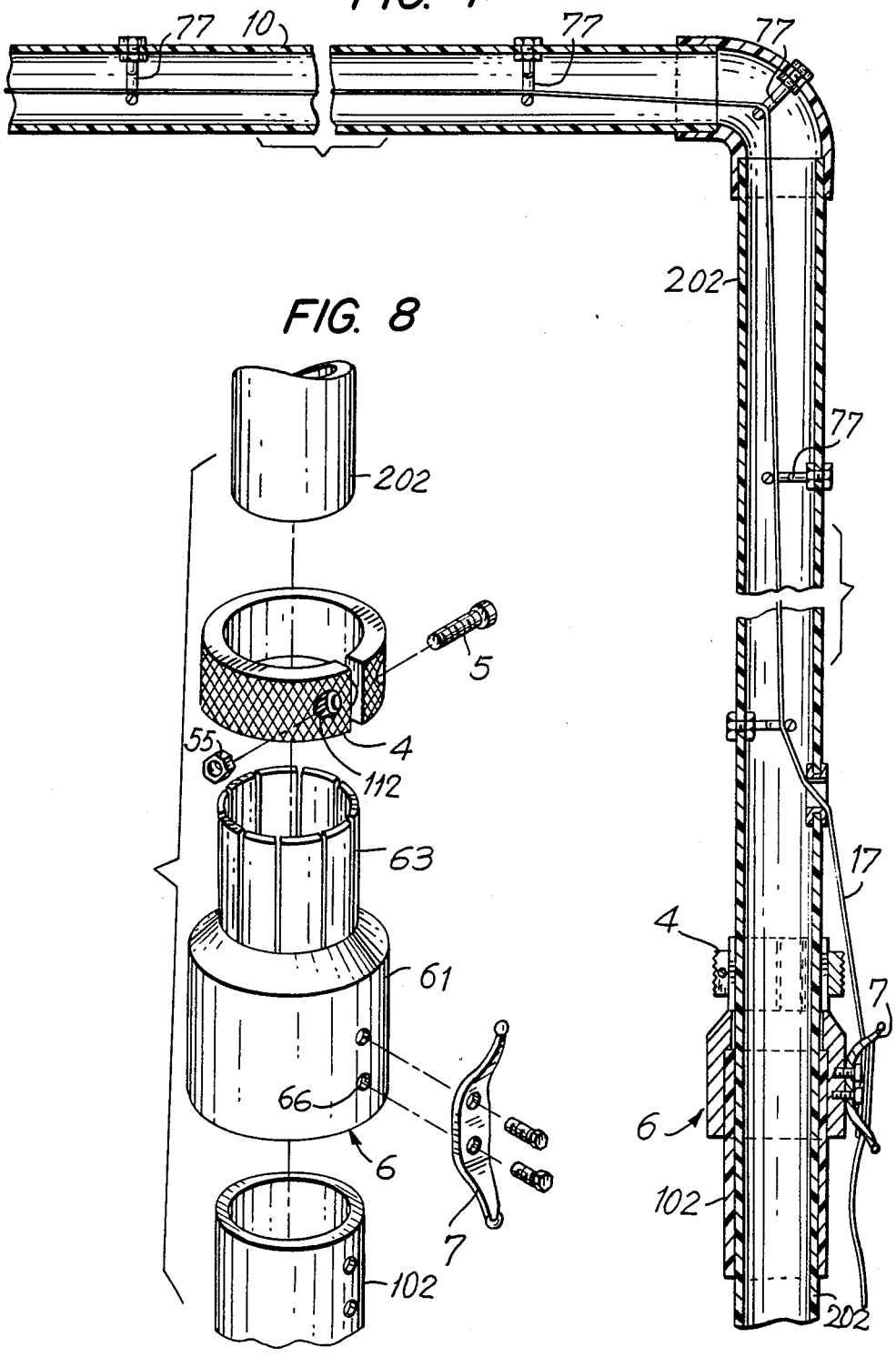
FIG. 7 is a cross-sectional view taken along lines 7—7 of FIG. 1.
FIG. 8 is an expanded exploded view of the height adjustment reducer means for the present invention.

The drawings presented herewith illustrate a preferred embodiment of the present invention, but are not to be taken as exclusive of the full scope of the present invention. Portions of the illustrated embodiment include conventional means which are often shown in schematic form. More detailed illustration is deemed unnecessary because of their conventional nature.

Referring to the drawings, the tennis practice device comprises a support base, generally indicated by the numeral 1, intended to rest on a horizontal surface, usually the ground. Alternatively, if the device will be used on soft earth, the base can be removed and a pointed end for implacement directly into the ground can be used. Secured to the base 1 is a telescoping vertical support post generally indicated by the numeral 2. The vertical support post 2 is formed from a lower, relatively larger diameter, post portion 102, and an upper, relatively smaller diameter, post portion 202 slidably held within the lower post portion 102. There is also provided a telescoping reducer coupling joint, generally indicated by the numeral 3, interconnecting the two portions of the vertical post 102, 202. The vertical support posts 102, 202 can be tubular or have a polygonal cross-section, as desired. It is only necessary that they mate together.

The telescopic joint 3 is formed of a unitary reducer member 6 and a split ring 4. The reducer member 6 has a lower large internal diameter portion 61, and an upper portion having a smaller internal diameter and formed of split fingers 63, which can be pressed together to securely hold the upper post portion 202. The reducer member 6 is secured to the upper end of the lower vertical post 102 as by bolts 66, which also secure a tie cleat 7 to the vertical post 2, passing through matching holes in the upper end of the lower post 102. Preferably, the holes at the upper end of the lower post 102 are internally threaded so as to make unnecessary the use of separate nuts. However, the reducer member 6 rests upon the upper end of the lower post 202, which thus supports the reducer member 6, and the upper post member 202.

The split locking collar ring 4 is removably and releasably located around the upper portion of the reducer member fingers 63, and the upper post portion 202. A locking bolt 5 extends through bolt holes in the flanges 142, located on either side of the split, and can be secured using the hand nut 55.

The split ring 4, which in its open position rests loosely around the upper slotted portion 206 of the swivel member, can be tightened by securing the tightening bolt 5 using hand nut 55 which serves to press the flanges 142 of the slotted ring 4 together, clamping the ring 4 tightly against the slotted fingers 63 and in turn firmly holding the upper support post 202 in the desired vertical position.

Secured to and extending substantially perpendicularly outwardly from the upper end of the upper post 202 is a horizontal tubular arm 10.

Secured to the end of the horizontal arm 10 is a curved tubular member 11, which in this case can be made of readily available off the shelf 45. angle elbows 111, 211, which results in lowering the end of the horizontal arm 10 to a level below that of the top of the vertical post 2. Secured to the end of the curved member 11 is a swivel head, generally indicated by the number 12. As shown, the swivel head is formed of a female/male threaded connector 312, holding in place a ball bearing swivel 13 including a central tube 14, and an unthreaded end cap 15; the threads on the male connector end serve to reduce the friction between the rotating end cap and the connector 312. A lubricant is also preferably applied to the threaded surfaces The end of the tube 14 protrudes through the center opening in the end cap 15 and is in turn secured to a female threaded opening in the stem of a ring member 16, such that the opening in tube 14 faces into the center of the ring 16.

A support filament 17 extends upwardly from the tie cleat 7 through an opening in the lower portion of the upper post 202 through the interior of the upper support pipe 202, the horizontal arm 10 and through the tube 14, hanging downwardly through the ring 16. The filament hanging downwardly from the ring 16 is secured either to, e.g., a mesh bag which will permanently hold the ball in place, or to a spring loaded arcuate member 22 which will releasably hold the ball in place until it is sharply struck, as by a tennis racket, and will then release the ball.

The ball suspension string 17, preferably passes through guides 77 secured within the upper post portion 202 and the horizontal arm 10. Alternatively, a continuous tube can be formed there within at least along the horizontal arm and part way down the vertical post 203, in place of the guide loops 77. It is also preferred that each surface against which the string 17 makes contact should be a low friction surface, such as a Teflon film.

In operation, the height of the horizontal arm 10 above the ground is set by loosening hand nut 55, to release the slotted ring collar 4, and thus relaxing the constriction on the slotted fingers 63 This permits the moving of the upper vertical post 202 upwardly or downwardly relative to the lower post portion 102, until the height of the arm is sufficient to permit free stroking by the player, without fear of hitting the horizontal arm 10 as the racket is swung. The split collar 4 is tightened utilizing the collar lock bolt 5 and hand nut 55, to secure the training device at the desired height.

Similarly, the vertical upper post 202 can be pivoted relative to the lower post portion 102, so that the horizontal arm 10 extends to the left or to the right of the vertical post 2, thus being tailored to either a left-handed or a right-handed player. This can be accomplished before the split collar is tightened.

Further, the height of the ball, i.e., the length it extends downwardly from the swivel head !2, can be set by loosening the string 17, or filament, tied around the tie cleat 7, and either pulling the string 17 downwardly or releasing additional length to provide for greater distance between the ball and the swivel head 12. The end of the string is then resecured to the tie cleat 7.

A ball is then attached to the hanging end of the string 17, using either a mesh 117, or a spring clip 217 and the player is prepared to practice service swings. The ball can be held in the hand, thrown upwardly and the racket can then strike it in a normal swinging action.

A preferred this system is formed of 2" OD pipe for the upper vertical post 202 and 2½" OD pipe, having a 2¼" ID, for the lower vertical post 102. The lower post 102 can be, for example, about 40" long, and the upper post 202 can be, for example, about 80" long. The vertical post 2 and the horizontal arm 10 can be made of various metals, or if desired, of synthetic polymers such as polyvinyl chloride. The curved end support members 11 and the swivel head outer piping 12 are preferably formed of the polymeric material for greater impact absorption. The support line can be, for example, fishing line of, e.g., 30 lb. test strength.

The patentable embodiments of this invention which are claimed are as follows:

1. A racket sport solo practice device comprising a tubular vertical support stand; telescoping length-adjusting means on said vertical support stand for permitting vertical adjustment of said vertical support stand; an elongated horizontal tubular support having one of its ends attached to the upper end of said vertical support stand and extending transversely therefrom; a rotatably supported head secured to said other end of the horizontal support and rotatable about an axis substantially parallel to and offset from the centerline of said horizontal support; and a flexible filamentary ball support movably supported within, and extending longitudinally through, said vertical support stand and said horizontal support, said filamentary ball support having one of its ends extending through an opening in said rotatable head and its other end exiting through an opening in the wall of said vertical support stand and being longitudinally movable through said rotatable head, said horizontal support and vertical support stand; ball-holding means secured to said one end of the filamentary support; said filamentary support hanging means secured to said rotatable head and extending outwardly therefrom so as to support the filamentary ball support at a position located axially and outwardly from said horizontal support, a force applied against a ball supported by said ball holding means in a direction transverse to the axis of the filamentary support will cause movement of said ball and of said filamentary support in a curved path in a plane transverse to the axis of said horizontal support and will cause rotary motion of the support head.

2. The practice device of claim 1, comprising a support base designed to extending transversely, and horizontally from, said vertical support stand and to rest upon a relatively flat surface;

3. The practice device of claim 1, further comprising a curved interconnect portion intermediate said rotatable support head and the horizontal support, the curved member comprising two curved portions of substantially equal but opposite curvature.

4. The practice device of claim 1, comprising line guide means secured internally of said horizontal support and vertical support said for supporting and guiding said the flexible filamentary support.

5. The practice device of claim 1, wherein said vertical support stand comprises two telescopically interconnected longitudinal sections and further comprising length adjusting means for locking said two telescoping sections together at a desired total length

6. The practice device of claim 5, wherein said length adjusting means comprises a reducing couple union.

* * * * *